United States Patent [19]

Baltz et al.

[11] Patent Number: 4,542,726

[45] Date of Patent: Sep. 24, 1985

[54] DECELERATION ENRICHMENT FUEL SYSTEM FOR AN INTERNAL COMBUSTION ENGINE

[75] Inventors: Gene F. Baltz, Lake Villa, Ill.; Warren G. Kingsley, Stuart, Fla.

[73] Assignee: Outboard Marine Corporation, Waukegan, Ill.

[21] Appl. No.: 626,973

[22] Filed: Jul. 2, 1984

[51] Int. Cl.[4] ..... F02M 3/00

[52] U.S. Cl. ..... 123/320; 123/73 A

[58] Field of Search ..... 123/329, 330, 320, 331, 123/73 A, 575, 577

[56] References Cited

U.S. PATENT DOCUMENTS

| | | | |
|---|---|---|---|
| 2,853,064 | 9/1958 | Karrasch | 123/326 |
| 3,881,685 | 5/1975 | Hase et al. | 261/DIG. 18 |
| 3,882,838 | 5/1973 | Nutten et al. | 123/330 |
| 4,026,168 | 5/1977 | Kobayashi | 74/860 |
| 4,038,819 | 8/1977 | Yoshikawa et al. | 60/307 |
| 4,194,483 | 3/1980 | McChesney | 123/179 G |
| 4,286,553 | 9/1981 | Baltz et al. | 123/187.5 R |
| 4,290,394 | 9/1981 | Frank et al. | 123/73 A |
| 4,309,968 | 1/1982 | DuBois | 123/187.5 R |
| 4,373,479 | 2/1983 | Billingsley et al. | 123/187.5 R |
| 4,375,206 | 3/1983 | Baltz et al. | 123/187.5 R |
| 4,382,047 | 5/1983 | Brown et al. | 261/41 D |
| 4,437,448 | 3/1984 | Billingsley | 123/577 |

*Primary Examiner*—William A. Cuchinski, Jr.
*Attorney, Agent, or Firm*—Michael, Best & Friedrich

[57] ABSTRACT

The internal combustion engine includes a carburetor having an air induction passage communicating with the engine combustion chamber and a throttle valve mounted inside the induction passage for pivotal movement between an idling speed position and a range of high speed positions, a primary fuel delivery system including a fuel pump for supplying fuel to the carburetor during normal engine operation, and a secondary fuel delivery system for supplying a flow of enrichment fuel to the engine combustion chamber, independently of the primary fuel delivery system, during periods of rapid engine deceleration. The secondary fuel delivery system includes conduit means communicating with the fuel pump and with the combustion chamber at a point downstream of the throttle valve, a solenoid-actuated valve movable between a normally closed position and an open position to respectively prevent and permit delivery of fuel through the conduit means from the fuel pump into the combustion chamber and a pressure-sensing switch assembly connected in communication with a low pressure zone in the induction passage downstream of the throttle wherein sub-atmospheric pressure is created by reciprocation of the engine piston. This switch assembly is operable to selectively energize the solenoid-actuated valve to the open position when the pressure in the low pressure zone is below a predetermined level. The secondary fuel delivery system preferably is arranged to also serve as a priming fuel system.

18 Claims, 1 Drawing Figure

DECELERATION ENRICHMENT FUEL SYSTEM FOR AN INTERNAL COMBUSTION ENGINE

BACKGROUND OF THE INVENTION

This invention relates to fuel supply systems for internal combustion engines and, more particularly, to such fuel supply or delivery systems arranged to provide enrichment fuel during engine operation.

Carburetors for internal combustion engines typically are calibrated to provide the appropriate amount of fuel when the throttle is in the closed position and the engine is idling. When the throttle is rapidly closed at high speeds, the engine can stall during rapid deceleration or hesitate when the engine is quickly accelerated after deceleration.

Attention is directed to the following U.S. Pat. Nos. which disclose prior fuel prming fuel and/or enrichment fuel systems for internal combustion engines:

| Patentee | U.S. Pat. No. | Issue Date |
|---|---|---|
| Karrasch | 2,853,064 | September 23, 1958 |
| McChesney, et al | 4,194,483 | May 25, 1980 |
| Baltz, et al. | 4,286,553 | September 1, 1981 |
| Frank, et al. | 4,290,394 | September 22, 1981 |
| DuBois | 4,309,968 | January 12, 1982 |
| Billingsley, et al. | 4,373,479 | February 15, 1983 |
| Baltz, et al. | 4,375,206 | May 1, 1983 |
| Brown, et al. | 4,382,047 | May 3, 1983 |
| Billingsley | 4,437,448 | March 20, 1984 |

Attention is also directed to the following pending United States patent applications, assigned to the assignee of the present application:

| Applicant | Ser. No. | Filing Date |
|---|---|---|
| McChesney, et al. | 338,335 | January 11, 1982 |
| Haman, et al. | 406,446 | August 9, 1982 |
| Billingsley, et al. | 461,866 | January 28, 1983 |
| Baltz, et al. | 508,943 | July 29, 1983 |

Attention is further directed to the following U.S. Pat. Nos. which disclose means for controlling throttling during deceleration:

| Patentee | U.S. Pat. No. | Issue Date |
|---|---|---|
| Hase, et al. | 3,881,685 | May 6, 1975 |
| Kobayashi, et al. | 4,026,168 | May 31, 1977 |
| Yoshikawa, et al. | 4,038,819 | August 2, 1977 |

SUMMARY OF THE INVENTION

The invention provides an internal combustion engine including means defining a low pressure zone wherein sub-atmospheric pressure is created in response to engine operation, a primary fuel delivery system for delivering fuel from a fuel source to the engine for normal engine operation, and a secondary fuel delivery system for delivering enrichment fuel to the low pressure zone in response to a pressure condition in the low pressure zone below a predetermined level.

In one embodiment, the primary fuel delivery system includes a fuel pump communicating with the fuel source and the secondary fuel delivery system includes conduit means communicating with the fuel pump and with the low pressure zone, valve means movable between a closed position to prevent delivery of fuel through the conduit means from the fuel pump into the low pressure zone and an open position to permit delivery of fuel through the conduit means from the fuel pump into the low pressure zone, and actuating means for selectively moving the valve means to the open position in response to the pressure in the low pressure zone decreasing below a predetermined level.

In one embodiment, the valve means includes a valve member and means for biasing the valve member toward the closed position and the actuating means includes an electrical solenoid which is operably connected to the valve member and which upon energization, is operable to overcome the force of the biasing means to move the valve member to the open position and an electrical control circuit connected to a source of electrical energy for supplying electrical energy to the solenoid and including a pressure-sensing switch connected in communication with the low pressure zone and operable to selectively energize the solenoid when the pressure in the low pressure zone is below said predetermined level.

In one embodiment, the engine includes a cylinder, a piston mounted in the cylinder for reciprocative movement therein and cooperating with the cylinder to define a combustion chamber, a carburetor having an air induction passage communicating with the combustion chamber and a throttle valve movable between an idling speed position and a range of high speed positions and the low pressure zone is located in the induction passage downstream of the throttle. The pressure-sensing switch is connected in communication with a port in the induction passage communicating with the low pressure zone.

The invention further provides an internal combustion engine including a cylinder extending from a crankcase, a piston mounted in the cylinder for reciprocative movement and cooperating with the cylinder to define a combustion chamber, a carburetor having an air induction passage communicating with the combustion chamber, a venturi and a throttle valve mounted inside the induction passage downstream of the venturi for movement between an idling speed position and a range of high speed positions. The induction passage has a low pressure zone downstream of the throttle valve wherein a sub-atmospheric pressure is created in response to reciprocative movement of the piston. The engine also includes a primary fuel delivery system including a fuel pump communicating with a source of fuel for supplying fuel from the fuel source to the carburetor during normal engine operation and a secondary fuel delivery system having conduit means communicating with the fuel pump and with the combustion chamber at a point downstream of the throttle valve, valve means in the conduit means movable between closed and open positions to respectively prevent and permit delivery of fuel through the conduit means from the fuel pump into the combustion chamber, and actuating means for selectively moving the valve means to the open position in response to the pressure in the low pressure zone decreasing to a predetermined level and maintaining the valve means in the open position until the pressure in the low pressure zone subsequently exceeds the predetermined level.

In one embodiment, the actuating means includes an electrical solenoid which is operably connected to the valve member of the control valve means and which, upon energization, is operable to move the valve member to the open position and an electrical control circuit connected to a source of electrical energy for supplying electrical energy to the solenoid and including a pressure-sensing switch connected in communication with the low pressure zone and operable to selectively energize the solenoid when the pressure in the low pressure zone is below the predetermined level.

In one embodiment, the electrical control circuit includes an engine ignition switch which is movable between "off", "on" and "start" positions, and which is electrically connected to the solenoid and operable to selectively energize the solenoid and open the valve member when the ignition switch is in the "start" position.

In one embodiment, the conduit means in connected in communication with a port communicating with the induction passage downstream of the throttle valve.

One of the principal features of the invention is the provision of an internal combustion engine having a primary fuel delivery system for delivering fuel to the engine combustion chamber during normal operation and a secondary fuel delivery system for delivering a flow of enrichment fuel to the engine combustion chamber, independently of the primary fuel delivery system, during rapid engine deceleration.

Another of the principal features of the invention is the provision of such an internal combustion engine wherein the secondary fuel delivery system is simply constructed and is capable of automatically supplying a flow of enrichment fuel when the pressure in the engine fuel intake is below a predetermined level.

Other features, advantages and aspects of the invention will become apparent to those skilled in the art upon reviewing the following detailed description, the drawing and the appended claims.

Figure 1:
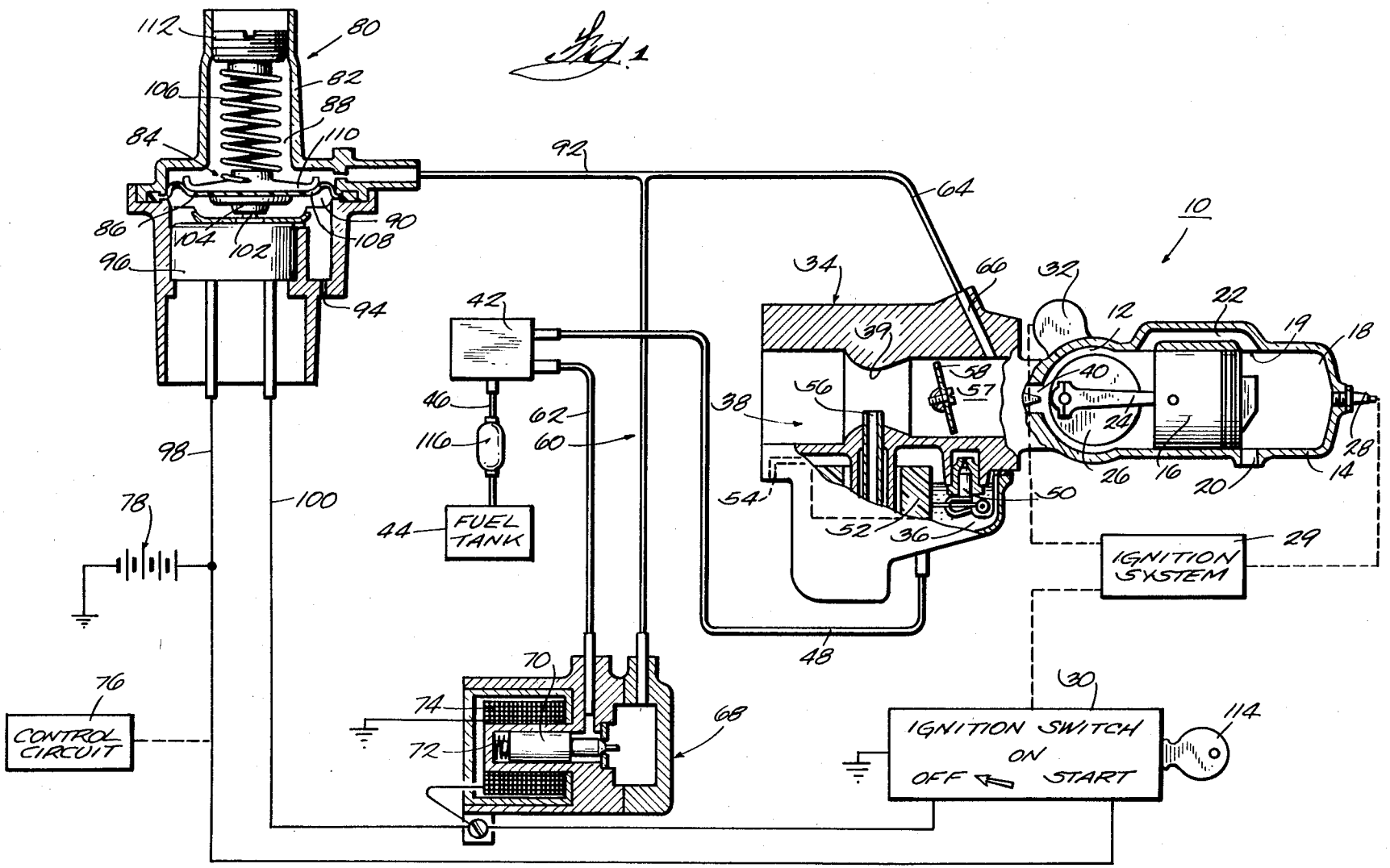
FIG. 1 is a schematic representation of an internal combustion engine embodying various features of the invention.

Before explaining at least one of the embodiments of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF THE PREFERRED EMBODIMENTS

Schematically illustrated in the drawing is an internal combustion engine 10 embodying various of the features of the invention. In the particular construction illustrated, the engine 10 is a two-cycle type and includes a crankcase 12, a cylinder 14 extending from the crankcase 12, and a piston 16 mounted for reciprocative movement inside the cylinder 14 and cooperating therewith to define a combustion chamber 18. The cylinder 14 includes an inlet port 19 and an outlet or exhaust port 20. The engine also includes a transfer passage 22 extending between the crankcase 12 and the inlet port 19.

The piston 16 is connected by a connecting rod 24 to a crankshaft 26 rotatably mounted in the crankcase 12. A sparkplug 28 extending into the cylinder 14 ignites an air-fuel mixture introduced into the combustion chamber 18, causing reciprocative movement of the piston 16 which drives the crankshaft 26. The inlet port 19 and the exhaust port 20 are open and closed in the usual manner during the compression and expansion strokes of the piston 16.

The engine 10 also has an ignition system 29 including an ignition switch 30 movable between "on", "off", and "start" positions and an electric starter motor 32 which is actuated to crank the engine 10, i.e., rotate the crankshaft 26, when the ignition switch 30 is moved to the "start" position.

An air-fuel mixture is supplied to the combustion chamber 18 via a carburetor 34 mounted on the crankcase 12 and having a fuel chamber 36. The carburetor 34 includes an induction passage 38 having a centrally located venturi 39. The induction passage 38 communicates with the atmosphere and directs an air-fuel mixture into the crankcase 12 through a conventional reed valve assembly 40.

A primary fuel delivery system is provided for delivering fuel from a source of fuel to the engine for normal engine operation. While other constructions can be used, in the specific embodiment illustrated, the primary fuel delivery includes a conventional fuel pump 42 which can be operated electrically or by the pulsating pressures produced in the crankcase 12 by piston reciprocation. The fuel pump 42 is connected to a source of fuel 44 via a conduit 46 and delivers fuel to the carburetor fuel chamber 36 via a primary fuel supply conduit 48. Flow of the fuel into the fuel chamber 36 is controlled by a valve 50 which is connected to a float 52 and opens and closes in response to movement of the float 52. Thus, the valve 40 and the float 52 serve to maintain a predetermined level of fuel in the fuel chamber 36. The carburetor 34 includes a vent passage 54 through which the fuel chamber 36 is vented to the atmosphere.

As air flows through the induction passage 38 toward the crankcase 12, fuel is drawn from the fuel chamber 36 into the induction passage 38 through a metered nozzle 56 and mixed with the incoming air. The resulting air-fuel mixture is drawn into the crankcase 12 through the reed valve assembly 40 and thereafter into the combustion chamber 18 through the transfer passage 22 and the inlet port 19 in response to the pulsating pressure variations occurring in the crankcase 12 during piston reciprocation. The reed valve assembly 40 opens as the pressure in the crankcase 12 decreases during the compression stroke of the piston 16 and closes as the pressure inside the crankcase 12 increases during the expansion stroke of the piston 16. As a consequence, a vacuum or sub-atmospheric pressure condition is created in the induction passage 38 in the vicinity or zone 57 upstream of the reed valve assembly 40.

Pivotally mounted in the induction passage 38 downstream of the venturi 39 is a throttle valve 58 which is movable between a substantially closed position, partially open positions and a fully opened position to control the air and fuel induction into the combustion chamber 18 and thereby control engine speed. The engine 10 operates at an idling speed when the throttle valve 58 is in the substantially closed position and at a range of higher speeds as the throttle valve 58 is moved from the substantially closed position toward the fully open position.

The carburetor 34 includes conventional means (not shown) for adjusting or calibrating the fuel flow into the induction passage 38. This fuel flow is adjusted to provide a fuel-to-air mixture ratio which provides smooth engine operation during idling. Thus, the carburetor 34 is adjusted to provide a predetermined fuel flow at the vacuum or reduced pressure condition normally existing in the induction passage 38 downstream of the throttle valve 58 when the throttle valve 58 is in the substantially closed position and the engine is idling.

During engine operation, if the throttle valve 58 is rapidly moved from a high speed position to the substantially closed position, the resulting rapid deceleration in engine speed produces a sub-atmospheric pressure in the crankcase 12 and the induction passage zone 57 between the throttle valve 58 and the reed valve assembly 40 which is lower than during steady state or normal engine idling. This reduced pressure is believed to induce nearly instantaneous vaporization of residual fuel in the crankcase. It is further believed that this, combined with the carburetor being unable to supply sufficient fuel at the lower-than-normal pressure or greater-than-normal vacuum results in a leaning condition which can cause the engine 10 to stall during deceleration or cause a hesitation when the engine throttle valve 58 is quickly moved back to a high speed position for rapid engine acceleration.

In order to minimize this problem, a secondary fuel or enrichment fuel delivery system is provided for automatically delivering enrichment fuel to the low pressure zone 57 in response to the pressure in the low pressure zone 57 being below a predetermined level. While other constructions can be used, in the specific embodiment illustrated, the enrichment fuel supply system includes a secondary fuel supply conduit 60 having an inlet 62 connected in communication with the fuel pump 42 and an outlet 64 connected in communication with the induction passage zone 57. More particularly, the outlet 64 of the secondary fuel supply conduit 60 is connected to a port or metering nipple 66 located on the carburetor 34 downstream of the throttle valve 58 and communicating with the induction passage zone 57. The nipple 66 controls the volume of fuel introduced into the induction passage 38 through the secondary fuel supply conduit 60 during operation of the fuel pump 42.

Valve means are provided for selectively permitting and preventing flow of fuel through the secondary fuel supply conduit 60. In the specific construction illustrated, such valve means includes a control valve 68 connected in the fuel supply conduit 60 between the fuel pump 42 and the nipple 66. The control valve 68 includes a valve member 70 which is movable between a normally closed position and an open position. When in the closed position, the valve member 70 prevents the flow of fuel through the secondary fuel supply conduit 60 even though the fuel pump 42 is operating. When in the open position, the valve member 70 permits the flow of fuel through the secondary fuel supply conduit 60 during operation of the fuel pump 42.

Actuating means are provided for selectively moving the valve member 70 from the normally closed position to the open position and for maintaining the valve 70 in the open position when the pressure in the induction passage zone 57 between the throttle valve 58 and the reed valve assembly 40 is below a predetermined level. In the specific construction illustrated, such actuating means includes a spring 72 biasing the valve member 70 toward the closed position and an electrical solenoid 74 which surrounds the valve member 70 and which, upon energization, is operable to move the valve member 70 to the open position against the biasing force of the spring 72.

The actuating means also includes an electrical control circuit 76 which is connected to a suitable source of electrical energy 78, such as a 12 volt battery, and controls the flow of electrical energy to the solenoid 74. The control circuit 76 includes a pressure-sensing switch assembly 80 which senses the pressure in the induction passage 38 between the throttle valve 58 and the reed valve assembly 40 and controls the flow of electrical energy to the solenoid 74 in response to that pressure. The switch assembly 80 has housing 82 defining an interior chamber 84, a movable member 86, such as a flexible diaphragm, dividing the chamber 84 into first and second sub-chambers 88 and 90. The first sub-chamber 88 is connected in communication with the induction passage 38 via a conduit 92 connected to the secondary fuel supply conduit 60 which in turn is connected to the nipple 66. The second sub-chamber 90 is vented to the atmosphere through a vent passage 94 in the housing 82.

The switch assembly 80 also includes a conventional electrical switch 96 electrically connected to the battery 78 via a lead 98 and electrically connected to the solenoid 74 via a lead 100. The switch 96 is constructed to be normally closed and is operable between an open or "off" position to prevent the flow of electrical energy through the switch assembly 80 and a closed or "on" position to permit the flow of electrical energy through the switch assembly 80.

The switch 96 includes an actuator or plunger 102 which is displaced to a switch "off" position in response to being engaged by a button 104 on the diaphragm 86. The diaphragm button 104 is biased toward displacing engagement with the switch plunger 102 by a spring 106 located in the first sub-chamber 88 and bearing against the diaphragm 86. The switch 96 is maintained in the open or "off" position to prevent the flow of electrical energy to the solenoid 74 as long as the pressure force (produced by atmospheric pressure) acting on the underside 108 of the diaphragm 86 is less than the combined spring force and pressure force (produced by the pressure in the zone of the induction passage 38 between the throttle valve 58 and the reed valve assembly 40) acting on the topside 110 of the diaphragm 86. The switch 96 is moved to the closed or "on" position to permit the flow of electrical energy to the solenoid 74 when the pressure force acting on the underside 108 of the diaphragm 86 exceeds the combined spring and pressure forces acting on the topside 110 of the diaphragm 86 and the diaphragm 86 is moved in a direction away from the plunger 102 a sufficient distance to permit plunger movement to the switch closed or "on" position.

Preferably, means are provided for adjusting the spring force applied to the diaphragm 86 so that the predetermined pressure at which the switch 96 moves to the closed or "on" position can be conveniently adjusted. In the specific construction illustrated, such means includes an adjustment stud 112 threaded into the housing 82 and bearing against the end of the spring 106 opposite to the end bearing against the diaphragm 86.

Other arrangements for controlling the supply of electrical energy to the solenoid 74 in response to the pressure in the low pressure zone 57 can also be employed.

During normal engine operation, the fuel pump 42 delivers fuel through the primary fuel conduit 48 to the carburetor fuel chamber 36. If the pressure in the zone 57 of the induction passage 38 between this throttle valve 58 and the reed valve assembly 40 decreases to a level below the pressure setting of the switch assembly 80 (due to rapid engine speed deceleration caused by rapidly moving the throttle valve 58 from a high speed position to the substantially closed position as discussed above), the switch 96 moves to the "on" position and the solenoid 74 is energized to open the valve member 70. As a consequence, in addition to delivering fuel through the primary fuel supply conduit 48, the fuel pump 42 delivers a flow of enrichment fuel through the secondary fuel supply conduit 60 and through the nipple 66 into the induction passage 38. This additional fuel prevents the air-fuel mixture being introduced into the crankcase 12 from becoming so lean that the engine stalls or tends to hesitate in the event the throttle valve 58 is quickly moved back to a high speed position for rapid engine acceleration.

In the specific construction illustrated, the secondary or enrichment fuel supply system is arranged to also serve as a priming fuel system. This is accomplished by making the ignition switch 30 part of the control circuit 76 and interconnecting the ignition switch 30 and the solenoid 74 so that the solenoid 74 can be selectively energized to open the valve member 70 when the ignition switch 30 is in the "start" position. In the specific construction illustrated, the ignition switch 30 is actuated by a key 114 and is operable to energize the solenoid 74 by pushing in on the key 114 when the ignition switch 30 is in the "start" position and to terminate the flow of electrical energy to the solenoid 74 when the key 114 is released. Thus, while the engine 10 is being cranked by the starter 32 in response to movement of the ignition switch 30 from the "off" position to the "start" position, a flow of enrichment fuel can be delivered by the fuel pump 42 through the secondary fuel supply conduit 60 to the induction passage 38 by pushing on the key 114.

The ignition switch 30 preferably is arranged so that the solenoid 74 also can be energized by pushing in on the key 114 when the ignition switch 30 is in the "on" position. Such an arrangement permits a flow of enrichment fuel to be delivered to the fuel pump 42 through the secondary fuel supply conduit 60 to the induction passage 38 at any time during engine operation at the option of the operator.

A manually operable fuel priming device can be provided to assist in priming. In the specific construction illustrated, a primer bulb 116 is connected between the fuel source 44 and the fuel pump 42. The primer bulb 116 is operable to pump fuel through the fuel pump 42 when the fuel pump 42 is not operating. The primer bulb 116 can be manually actuated to pump fuel through the primary fuel supply conduit 48 into the carburetor fuel chamber 36 and to fill the secondary fuel supply conduit 60 up to the control valve 68.

Priming fuel can be introduced into the induction passage 38 by moving the ignition switch 30 from the "off" position to the "on" position, pushing in on the key 114 to energize the solenoid 74 and open the valve member 70, and then manually actuating the primer bulb 116.

In the specific construction illustrated, the secondary fuel supply conduit 60 is connected in communication with the combustion chamber 18 through the nipple 66 which also serves as the pressure sensing port for the switch assembly 80. If desired, the secondary fuel supply conduit 60 can be connected in communication with the combustion chamber 18 at other suitable points on the engine 10, for example, directly to the crankcase 12 or the transfer passage 22.

Various of the features of the invention are set forth in the following claims:

We claim:

1. An internal combustion engine comprising means defining a low pressure zone wherein sub-atmospheric pressure is created in response to engine operation, a primary fuel delivery system for delivering fuel from a fuel source to said engine for normal engine operation, and a secondary fuel delivery system for delivering enrichment fuel from a fuel source to said low pressure zone, said secondary fuel delivery system including normally closed valve means for controlling fuel flow to said low pressure zone, and means for selectively actuating said valve means to an open position in response to a pressure in said low pressure zone below a predetermined level.

2. An internal combustion engine comprising means defining a low pressure zone wherein sub-atmospheric pressure is created in response to engine operation, a primary fuel delivery system for delivering fuel from a fuel source to said engine for normal engine operation, said primary fuel delivery system including a fuel pump communicating with the fuel source, a secondary fuel delivery system for delivering enrichment fuel to said low pressure zone from a fuel source, said secondary fuel delivery system including conduit means communicating with said fuel pump and with said low pressure zone, valve means in said conduit means movable between a closed position to prevent delivery of fuel through said conduit means from said fuel pump into said low pressure zone and an open position to permit delivery of fuel through said conduit means from said fuel pump into said low pressure zone, and actuating means for selectively moving said valve means to the open position in response to a pressure in said low pressure zone below a predetermined level.

3. An internal combustion engine according to claim 2 wherein said valve means includes a valve member and means for biasing said valve member toward the closed position and wherein said actuating means includes an electrical solenoid which is operably connected to said valve member and which, upon energization, is operable to overcome the force of said biasing means to move said valve member to the open position, and electrical control circuit means connected to a source of electrical energy for supplying electrical energy to said solenoid and including a pressure-sensing switch means connected in communication with said low pressure zone and operable to selectively energize said solenoid when the pressure in said low pressure zone is below said predetermined level.

4. An internal combustion engine according to claim 3 and further including a cylinder, a piston mounted in said cylinder for reciprocative movement therein and cooperating with said cylinder to define a combustion chamber, a carburetor having an air induction passage communicating with said combustion chamber and a throttle valve movable between an idling speed position and a range of high speed positions, said low pressure zone being located in said induction passage downstream of said throttle, and a port in said induction passage communicating with said low pressure zone, and wherein said pressure-sensing switch is connected in communication with said port.

5. An internal combustion engine according to claim 4 wherein said pressure-sensing switch means includes a housing defining a chamber, a movable member dividing said chamber into a first sub-chamber communicating with said port and a second sub-chamber communicating with the atmosphere, an electrical switch movable between "off" and "on" positions, means on said movable member for engaging and moving said switch from the "on" position to the "off" position, means biasing said movable member toward a switch "off" position when the pressure in said first sub-chamber is above said predetermined level and for permitting said movable member to move to a position affording movement of said switch to the "on" position when the pressure in said first sub-chamber is below said predetermined level.

6. An internal combustion engine comprising a crankcase, a cylinder extending from said crankcase, a piston mounted in said cylinder for reciprocative movement therein and cooperating with said cylinder to define a combustion chamber, a carburetor having an air induction passage communicating with said combustion chamber, a venturi and a throttle valve mounted inside said induction passage downstream of said venturi for movement between an idling speed position and a range of high speed positions, said induction passage having a low pressure zone downstream of said throttle valve wherein sub-atmospheric pressure is created in response to reciprocative movement of said piston, a primary fuel delivery system including a fuel pump communicating with a source of fuel for supplying fuel from the fuel source to said carburetor during engine operation, and a secondary fuel delivery system including conduit means communicating with said fuel pump and with said combustion chamber at a point downstream of said throttle valve, valve means in said conduit means movable between a closed position to prevent delivery of fuel through said conduit means from said fuel pump into said combustion chamber and an open position to permit delivery of fuel through said conduit means from said fuel pump into said combustion chamber, and actuating means for selectively moving said valve means to the open position in response to the pressure in said low pressure zone decreasing to a predetermined level.

7. An internal combustion engine according to claim 6 wherein said valve means includes a valve member and means for biasing said valve member toward the closed position and wherein said actuating means includes an electrical solenoid which is operably connected to said valve member and which, upon energization, is operable to overcome the force of said biasing means to move said valve member to the open position, and electrical control circuit means connected to a source of electrical energy for supplying electrical energy to said solenoid and including a pressure-sensing switch means connected in communication with said low pressure zone and operable to selectively energize said solenoid when the pressure in said low pressure zone is below said predetermined level.

8. An internal combustion engine according to claim 7 wherein said electrical control circuit means includes an engine ignition switch movable between "off", "on" and "start" positions, said ignition switch being electrically connected to said solenoid and operable to selectively energize said solenoid and open said valve member when said ignition switch is in the "start" position.

9. An internal combustion engine according to claim 8 wherein said ignition switch is also operable to selectively energize said solenoid and open said valve member when said ignition switch is in the "on" position.

10. An internal combustion engine according to claim 7 and further including a port communicating with said induction passage downstream of said throttle valve and wherein said pressure-sensing switch means is connected in communication with said port.

11. An internal combustion engine according to claim 10 wherein said pressure-sensing switch means includes a housing defining a chamber, a movable member dividing said chamber into a first sub-chamber communicating with said port and a second sub-chamber communicating with the atmosphere, an electrical switch movable between "off" and "on" positions, means on said movable member for engaging and moving said switch from the "on" position to the "off" position, means biasing said movable member toward a switch "off" position when the pressure in said first sub-chamber is above said predetermined level and for permitting said movable member to move to a position affording movement of said switch to the "on" position when the pressure in said first sub-chamber is below said predetermined level.

12. An internal combustion engine according to claim 10 wherein said conduit means is connected in communication with said port.

13. An internal combustion engine according to claim 6 and further including a manually operable device for pumping fuel connected in communication with the fuel source and with said conduit means via said fuel pump.

14. An internal combustion engine comprising a crankcase, a cylinder extending from said crankcase, a piston mounted in said cylinder for reciprocative movement therein and cooperating with said cylinder to define a combustion chamber, a carburetor having an air induction passage communicating with said combustion chamber, a venturi and a throttle valve mounted inside said induction passage downstream of said venturi for pivotal movement between an idling speed position and a range of high speed positions, said induction passage having a low pressure zone downstream of said throttle valve wherein sub-atmospheric pressure is created in response to reciprocative movement of said piston, a primary fuel delivery system including a fuel pump communicating with a source of fuel for supplying fuel from the fuel source to said carburetor during engine operation, and a secondary fuel delivery system including conduit means communicating with said fuel pump and with said combustion chamber at a point downstream of said throttle valve, a control valve in said conduit means including a valve member movable between a normally closed position to prevent delivery of fuel through said conduit means from said fuel pump into said combustion chamber and an open position to permit delivery of fuel through said conduit means from said fuel pump into said combustion chamber and an electrical solenoid operable, upon energization, to move said valve member to the open position, and electrical control circuit means connected to a source of electrical energy for supplying electrical energy to said solenoid and including a pressure-sensing switch means connected in communication with said low pressure zone and operable to energize said solenoid in response to the pressure in said low pressure zone decreasing below a predetermined level and to continue energizing said solenoid until the pressure in said low pressure zone subsequently exceeds said predetermined level.

15. An internal combustion engine according to claim 14 wherein said electrical control circuit means includes an engine ignition switch movable between "off", "on" and "start" positions, said ignition switch being electrically connected to said solenoid and operable to selectively energize said solenoid and open said valve member when said ignition switch is in either the "on" position or the "start" position.

16. An internal combustion engine according to claim 15 and further including a port communicating with said induction passage downstream of said throttle valve and wherein said pressure-sensing switch and said conduit means are connected in communication with said fuel inlet port.

17. An internal combustion engine according to claim 16 wherein said pressure-sensing switch means includes a housing defining a chamber, a movable member dividing said chamber into a first sub-chamber communicating with said port and a second sub-chamber communicating with the atmosphere, an electrical switch movable between "off" and "on" positions, means on said movable member for engaging and moving said switch from the "on" position to the "off" position, means biasing said movable member toward a switch "off" position when the pressure in said first sub-chamber is above said predetermined level and for permitting said movable member to move to a position affording movement of said switch to the "on" position when the pressure in said first sub-chamber is below said predetermined level.

18. An internal combustion engine comprising means defining a low pressure zone wherein sub-atmospheric pressure is created in response to engine operation, a primary fuel delivery system for delivering fuel from a fuel source to said engine for normal engine operation, and a secondary fuel delivery system for delivering enrichment fuel to said low pressure zone from a fuel source, said secondary fuel delivery system including conduit means communicating with a fuel source and with said low pressure zone, valve means in said conduit means movable between a closed position to prevent delivery of fuel through said conduit means from the fuel source into said low pressure zone and an open position to permit delivery of fuel through said conduit means from the fuel source into said low pressure zone, and actuating means for selectively moving said valve means to the open position in response to a pressure in said low pressure zone below a predetermined level.

* * * * *